US005454696A

United States Patent [19]

Wilkinson

[11] Patent Number: 5,454,696

[45] Date of Patent: Oct. 3, 1995

[54] VACUUM INDUCING PUMP

[76] Inventor: Ernest H. Wilkinson, P.O. Box 103, Encino, Tex. 78353

[21] Appl. No.: 266,255

[22] Filed: Jun. 27, 1994

[51] Int. Cl.[6] ..... F04F 5/44; F04F 5/00; B05B 7/06

[52] U.S. Cl. ..... 417/198; 417/151; 417/194; 239/432

[58] Field of Search ..... 417/151, 194, 417/198; 239/366, 432

[56] References Cited

U.S. PATENT DOCUMENTS

| | | | |
|---|---|---|---|
| 842,100 | 1/1907 | von Lindenstamm | 417/151 |
| 2,172,522 | 9/1939 | Sline | 417/198 |
| 3,923,247 | 12/1975 | White | 239/432 |

FOREIGN PATENT DOCUMENTS

| | | | |
|---|---|---|---|
| 0948350 | 8/1949 | Germany | 417/198 |
| 0717409 | 2/1980 | U.S.S.R. | 417/198 |
| 0771360 | 10/1980 | U.S.S.R. | 417/194 |
| 1665105 | 7/1991 | U.S.S.R. | 417/194 |

*Primary Examiner*—Richard A. Bertsch
*Assistant Examiner*—Ted Kim
*Attorney, Agent, or Firm*—G. Turner Moller

[57] ABSTRACT

A jet pump includes a power fluid inlet, a pumped fluid inlet having a conduit therein, a fluid outlet and a downstream structure of generally frustoconical shape having a small end adjacent the pumped fluid inlet conduit, a large end downstream of the small end and a central passage. In several embodiments, the downstream structure is a series of washer like rings of increasing size. In other embodiments, the downstream structure is a solid body. Several embodiments include an upstream structure having a central power fluid inlet conduit sealed relative to the pump housing having a disc thereon downstream of the pumped fluid inlet. The disc provides a series of passages in the form of notches in the disc periphery or openings through the disc body.

10 Claims, 5 Drawing Sheets

VACUUM INDUCING PUMP

This invention relates to an improved jet or jet pump for inducing a vacuum in a fluid system.

The simplest form of a jet or jet pump comprises a power fluid conduit which simply extends into a pumped fluid conduit and is aimed in the direction of intended fluid flow. One particular type jet is known as a Perry jet and is widely used to jet water from water wells. A Perry jet comprises a J-shaped power fluid conduit inside the well casing with a perforated plate on the end of the short leg of the J.

More complex jet plumps are well known in the art and comprise a pumped fluid inlet, a power fluid inlet, a nozzle through which the power fluid flows to produce a low pressure area near the pumped fluid inlet and a diffuser downstream of the nozzle causing the commingled fluid stream to slow down in an orderly sort of way. The nozzle causes the power fluid stream to accelerate and generate the low pressure area into which the pumped fluid flows. The diffuser reverses the reaction to slow down the fluid flow and raise the pressure of the commingled stream. The inefficiency of a jet pump is a result of the losses occurring in each of these operations.

Disclosures of some interest relative to this invention are found in U.S. Pat. Nos. 655,615; 2,786,651; 3,545,492; 3,730,673; 3,996,025 and 4,964,733.

The jet pump of this invention is of somewhat different configuration and, in some embodiments, resembles a Perry jet. The jet pump of this invention comprises a housing having a pumped fluid inlet, a generally cylindrical conduit section and an outlet spaced downstream from the pumped fluid inlet defining an axis of fluid movement, a power fluid inlet including a conduit opening into the housing parallel to the axis at a location between the pumped fluid inlet and the outlet, and a structure downstream of the power fluid inlet conduit, the structure including a body in the cylindrical body section having a central passage on the axis of fluid movement, the body section having an outer surface spaced from the cylindrical body section and diverging in the downstream direction. Most of the embodiments of this invention also comprise a plate adjacent the end of the power fluid inlet conduit extending radially toward the housing, the plate providing passages therethrough for the pumped fluid.

It is an object of this invention to provide an improved jet pump.

A more specific object of this invention is to provide jet pump having a structure downstream of the junction of power and pumped fluid.

Another more specific object of this invention is to provide a plate around the power fluid conduit providing passages there-through for the pumped fluid.

These and other objects of this invention will become more fully apparent as this description proceeds, reference being made to the accompanying drawing and appended claims.

Figure 1:
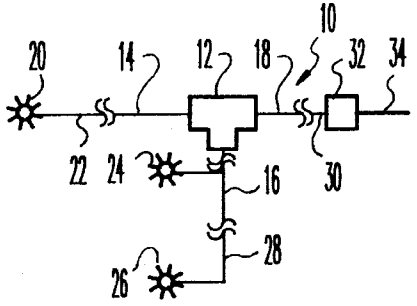
FIG. 1 is a schematic view of one application of the improved jet pump of this invention.

Referring to FIG. 1, a jet pump 10 of this invention includes a housing 12 having a power fluid inlet end 14, a pumped fluid inlet 16 and a fluid outlet 18. The power fluid inlet end 14 is connected to a gas well 20 through a flow line 22 and the pumped fluid inlet 16 is connected to a pair of gas wells 24, 26 through a flow line 28. The gas well 20 is considerably stronger than the wells 22, 24, i.e. it is capable of producing a larger quantity of gas and/or at higher pressures than the wells 22, 24. The jet pump 10 acts to convert the energy of gas from the high volume/high pressure well 20 into a decreased back pressure which the wells 24, 26 have to produce against. The pressure at the pumped fluid inlet 16 is accordingly much reduced compared to a production system without the jet pump 10. The commingled gas from the outlet 18 typically passes through a flow line 30 to a conventional gas compressor or treatment facility 32 and then to a sales line 34.

Figure 2:
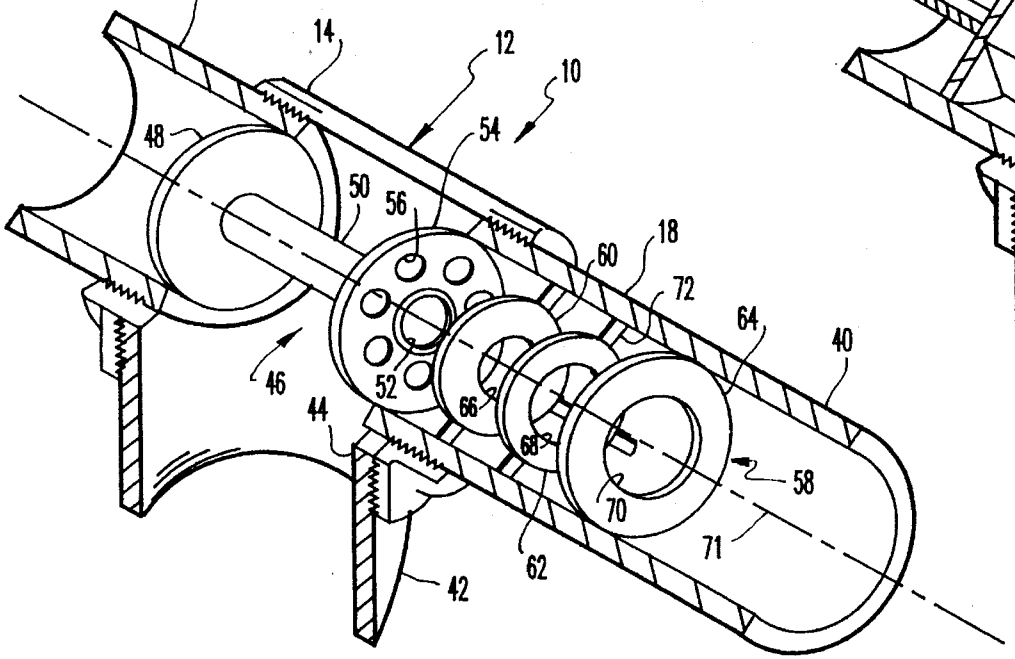
FIG. 2 is a broken isometric view of one embodiment of the jet pump of this invention.

Referring to FIG. 2, the jet pump 10 is illustrated in more detail. The housing 12 may conveniently comprise a threaded tee having the flow line 22 or a nipple 38 threaded into the power fluid inlet end 14. A second nipple or short cylindrical pipe section 40 threads into the tee 12 and provides the fluid outlet 18. The flow line 28 or a third nipple 42 threads into the pumped fluid inlet 16.

Extending across an opening 44 provided by the pumped fluid inlet 16 is a power fluid inlet structure 46 comprising a first plate 48 sealed relative to the power fluid inlet 14 in any suitable fashion, as by threads, welding or the like. A small power fluid inlet conduit 50 having a passage 52 therethrough opens through the first plate 48 and through a second plate 54 which is likewise sealed against the conduit 40 in any suitable fashion, as by threading, welding or the like. The second plate 54 provides a plurality of passages 56 therethrough providing communication between the pumped fluid inlet 16 and downstream of the structure 46.

Downstream of the second plate 54 is a downstream or outlet structure 58 in the position of a diffuser. The structure 58 comprises a series of annular rings or washer-like devices 60, 62, 64. The rings 60, 62, 64 are illustrated as planar but may be slightly dished or concave facing the downstream direction. The rings 60, 62, 64 are of increasing outer diameter in the downstream direction and provide openings 66, 68, 70 which also are of increasing diameter in the downstream direction. The rings 60, 62 are fixed in position in any suitable manner, as by the provision of struts 72 while the ring 64 is of sufficient outer diameter to be directly welded against the interior of the conduit 40. The openings 66, 68, 70 are coaxial with an axis 71 which is aligned with the passage 52. The openings 66, 68, 70 diverge in the downstream direction at an angle between 15°–20° relative to the axis 71, and preferably at an angle of 17°.

In use, relatively high volume, high pressure fluid, either gas, liquid or a mixture thereof, passes through the power fluid inlet 14 into the power fluid inlet conduit 50. The velocity of the power fluid increases substantially and the pressure in the housing adjacent the downstream end of the second plate 54 is thereby lowered substantially. This creates a low pressure area open to the pumped fluid inlet 16 allowing flow of the pumped fluid into the housing 12.

Downstream of the second plate 54, the power fluid and pumped fluid commingle and then pass through the openings 66, 68, 70 into the fluid outlet conduit 40.

For reasons which are not entirely understood, the low pressure generated at the pumped fluid inlet 16 is quite remarkably low. Quite good vacuums have been achieved, even when handling substantial quantities of pumped fluids.

Figure 3:
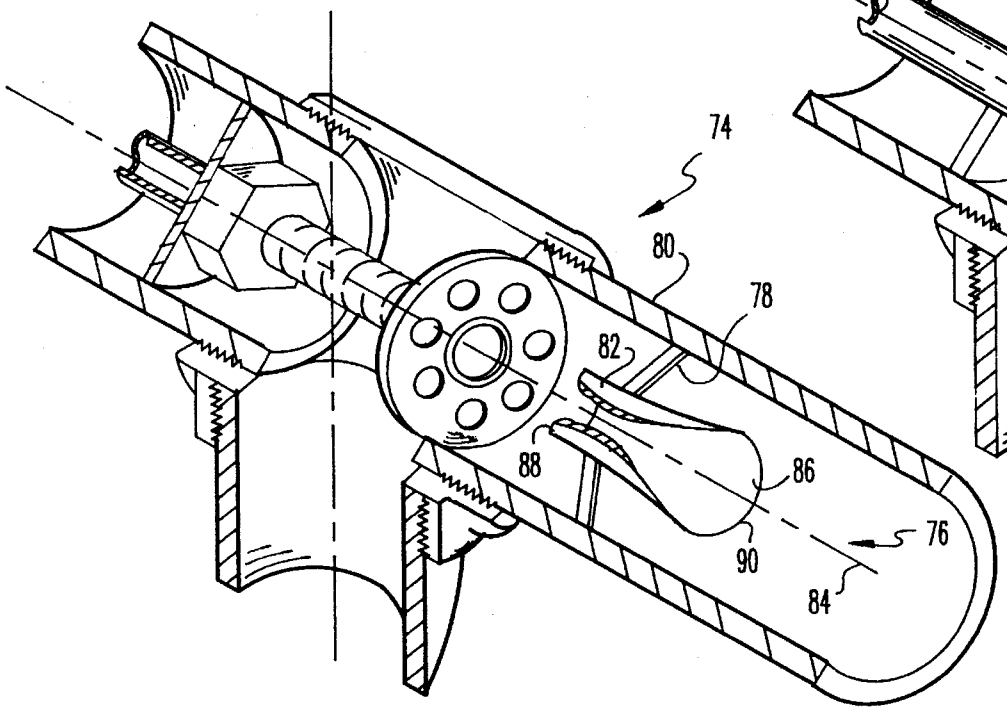
FIG. 3 is a broken isometric view of another embodiment of this invention.

Referring to FIG. 3, another embodiment 74 of the jet pump of this invention is illustrated. The jet pump 74 is identical to the jet pump 10 except that the downstream structure 76 is different than the ring structure 58. The downstream structure 76 is of annular shape having one .or more struts 78 fixing the structure 76 in position in the fluid outlet section 80 which is more-or-less the same as the housing 12. The structure 76 provides an external surface 82 of slightly increasing diameter in the downstream direction, not more than about a 4° angle relative to the central axis 84. The internal surface 86 of the structure 76 is, in cross-section, of air foil shape with the blunt or forward end 88 facing upstream and the trailing end 90 facing downstream as suggested by the cutaway section in FIG. 3. In use, the jet pump 74 works in substantially the same fashion as the jet pump 10. In use, the jet pump 74 works in substantially the same fashion as the jet pump 10.

Figure 4:
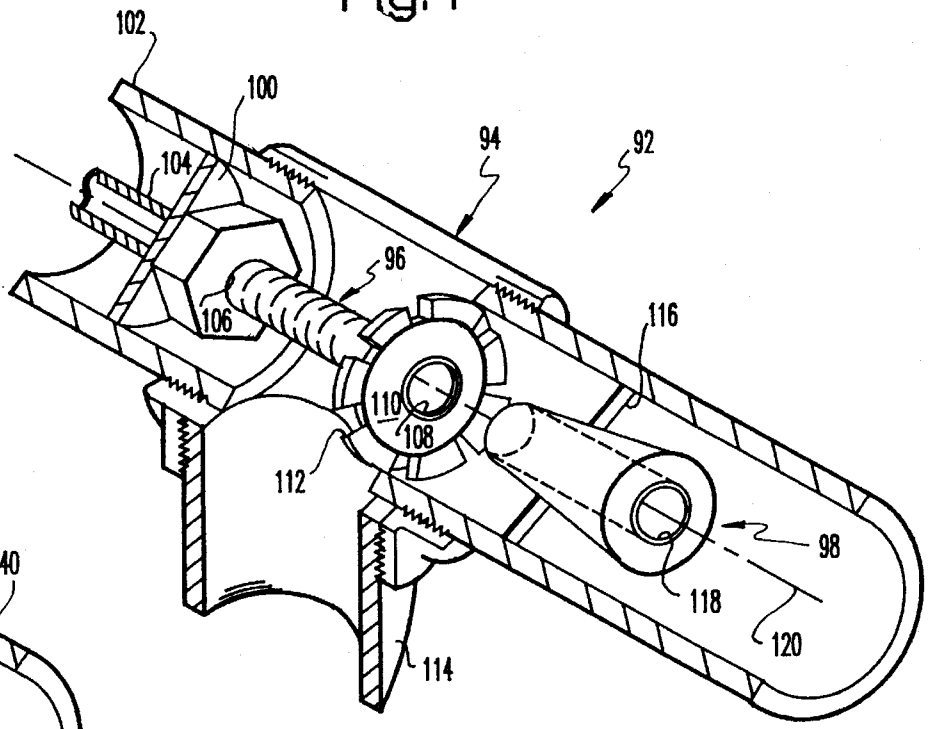
FIG. 4 is a broken isometric view of another embodiment of this invention.

Referring to FIG. 4, another embodiment 92 of the jet pump of this invention is illustrated. The jet pump 92 has a housing 94 more-or-less identical to the housing 12 but the upstream and downstream structures 96, 98 are different. The inlet structure 96 is similar to the structure 46 and includes a first plate 100 sealed relative to the power fluid inlet end 102 of the housing 94, an external threaded power fluid conduit 104 received in a threaded passage 106 and having a passage 108 therethrough opening through the first plate 100 and through a second plate 110 which is juxtaposed to or abuts against the housing 94 and may be secured thereto in any suitable fashion, as by threading, welding or the like. The second plate 110 provides a plurality of evenly spaced peripheral notches 112 providing communication between the pumped fluid inlet 114 and downstream of the structure 96. Thus, the major difference between the inlet structures 46, 96 will be seen to reside in the passages across the second plates 54, 110 and in the axial adjustability of the plate 110 as allowed by the threaded connection between the conduit 104 and the passage 106.

The downstream structure 98 is of frustoconical shape supported from the housing 94 in any suitable fashion, as by the provision of struts 116. The structure 98 includes a central cylindrical passage 118 concentric about an axis 120 and aligned relative to the passage 106.

In use, the jet pump 92 works in substantially the same fashion as either of the jet pumps 10, 74 except that the axial position of the plate 110 may be adjusted by threadably advancing or threadably retracting the power fluid inlet conduit 104 relative to the pumped fluid inlet opening 114.

Figure 5:
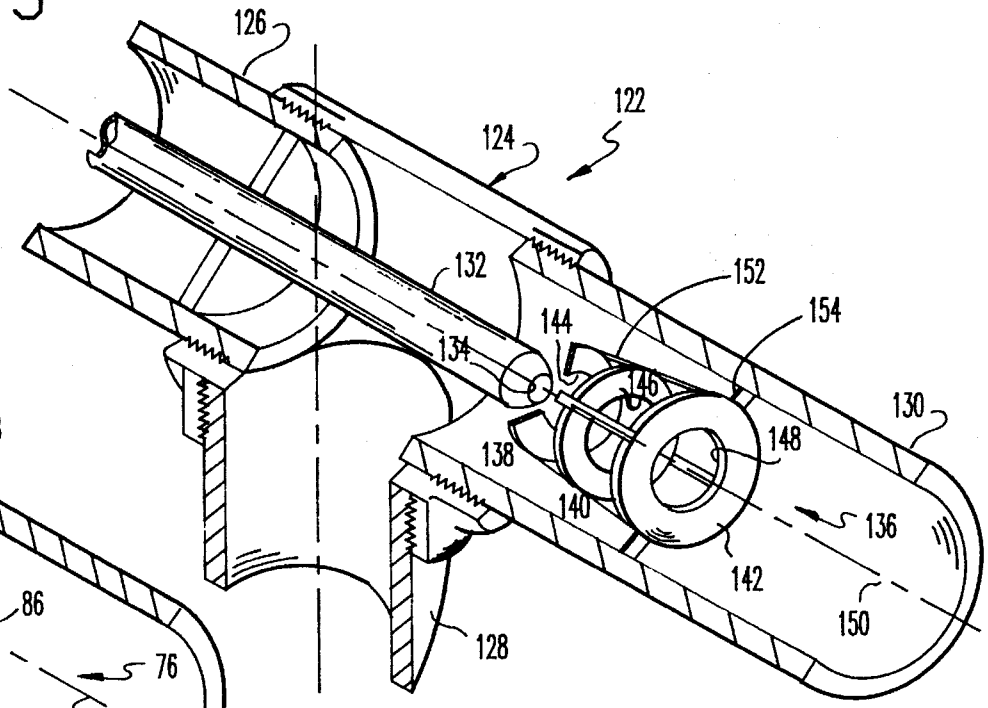
FIG. 5 is a broken isometric view of another embodiment of this invention.

Referring to FIG. 5, there is illustrated another embodiment of this invention comprising a jet pump 122 of somewhat simpler design. The jet pump 122 includes a housing 124 having a power fluid inlet end 126, a pumped fluid inlet 128 and a commingled fluid outlet 130. A power fluid inlet conduit 132 is sealed relative to the inlet end 126 of the housing 124 and extends downstream past the end of the pumped fluid inlet 128 providing an outlet opening 134. A downstream structure 136 is similar to the downstream structure 58 of the jet pump 10 and includes a series of circular rings 138, 140, 142 of increasing diameter having passages 144, 146, 148 of increasing diameter in the downstream direction. The passages 144, 146, 148 are coaxial with an axis 150 which aligns with the opening 148. A series of support members 152 connect the rings 138, 140, 142 together and one or more struts 154 secure the structure 136 in position in the housing. 124.

Figure 6:
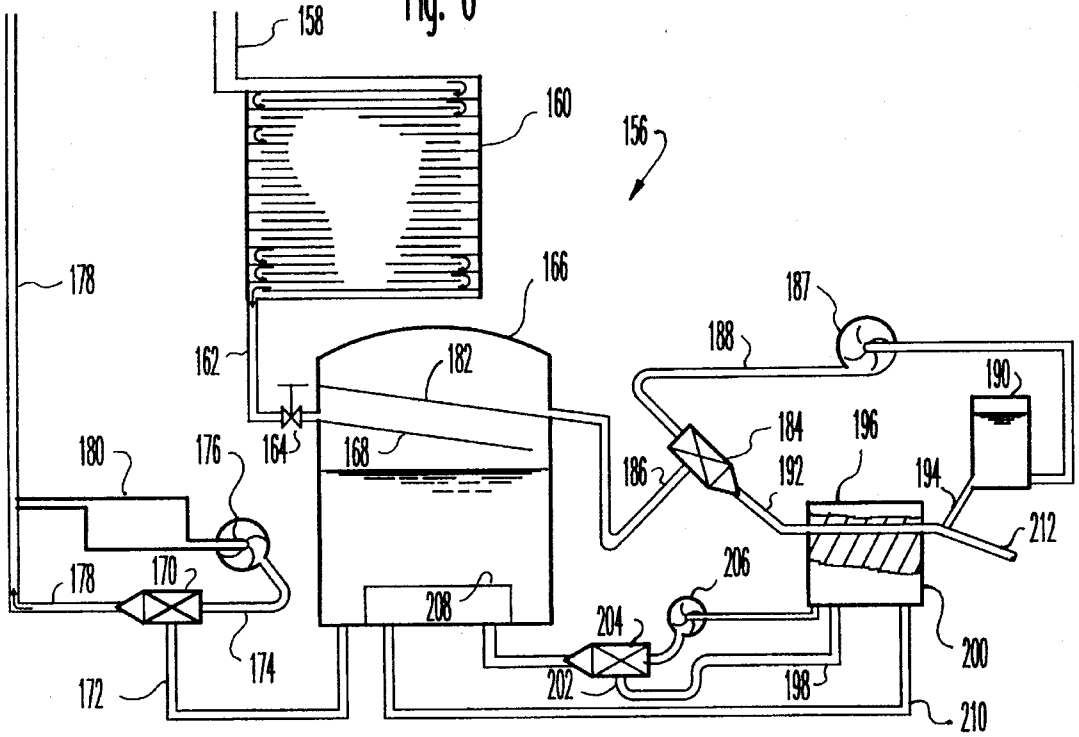
FIG. 6 is a schematic view of another application of the improved jet pump of this invention.

The jet pumps of this invention are characterized by the ability to create a substantial pressure reduction in the vicinity of the pumped fluid inlet. This characteristic has many advantages, particularly in an application such as shown in FIG. 6 which illustrates a desalinization plant 156 having an inlet 158 receiving brackish or saline water from any suitable source at atmospheric temperature and pressure e.g. 85° F. 14.65 psia. The brackish water passes into a solar heater 160 of any suitable description and provides an elevated outlet temperature, e.g. 170° F. and a reduced pressure, e.g. 5 psia, for reasons more fully apparent hereinafter.

Brackish water exiting from the solar heater 160 passes through a conduit 162 and throttling valve 164 into a flash chamber 166 having one or more inclined run-off surfaces 168 spreading the water out in a relatively thin sheet to allow water to evaporate in the low pressure atmosphere in the chamber 166. Water collects in the bottom of the chamber 166 and is discharged by a jet pump 170 of this invention having an inlet 172 open to the bottom of the chamber 166, a power fluid inlet 174 receiving pumped water from a mechanical pump 176 connected to the outlet 178 through a surge tank 180. It will thus be seen that salts in the brackish water accumulate in the water discharged through the jet pump 170 back into the bay or ocean from which inlet water is taken.

One or more inclined bubbler trays 182 in the flash chamber collect condensed water vapor evaporating off the thin sheet spreading over the inclined surfaces 168. Because of the evaporation occurring in the flash chamber 166, the temperature falls substantially, to e.g. 95° F. The pressure in the flash chamber 166 is quite low, preferably less than 1 psia, because a jet pump 184 has its inlet 186 open to the runoff of the bubbler tray 182 so that water vapor and fresh water are drawn off from the flash chamber 166. The jet pump 184 is powered by high pressure fresh water, typically about 60 psia, delivered by a mechanical pump 187 through a power fluid inlet 188. The pump 187 has its inlet through a surge tank 190 open to the discharge conduit 192 downstream of a condensation unit or conduit 194. Typically, the discharge conduit 192 of the pump 184 contains water and water vapor in the neighborhood of 150° F. and 45 psia.

Uncondensed water vapor in the discharge conduit 192 is condensed by the refrigeration system 196. Cool, low pressure refrigerant vapor exits through a conduit 198 from an evaporator 200 in heat exchange relation with the condensation unit 194 into the pumped fluid inlet 202 of a jet pump 204 of this invention. High pressure power refrigerant fluid is delivered from a mechanical pump 206 having its inlet open to cool, low pressure refrigerant vapor from the evaporator 200. The hot, high pressure refrigerant gas exiting from the pump 204 enters a condenser 208 in the flash chamber 166 where the refrigerant condenses into a warm, high pressure liquid. The warm, high pressure liquid passes through a conduit 210 into a nozzle (not shown) open to the evaporator 200 to produce a cold, low pressure gas which absorbs heat from the water vapor in the condensing conduit 194. The refrigerant used in the system 196 may be of any suitable type, such as ammonia, propane, the newer chlorofluorocarbons and the like.

It will thus be seen that the desalinization system 156 delivers fresh water through an outlet 212, typically at about 125° F. and somewhat above atmospheric pressure.

Figure 7:
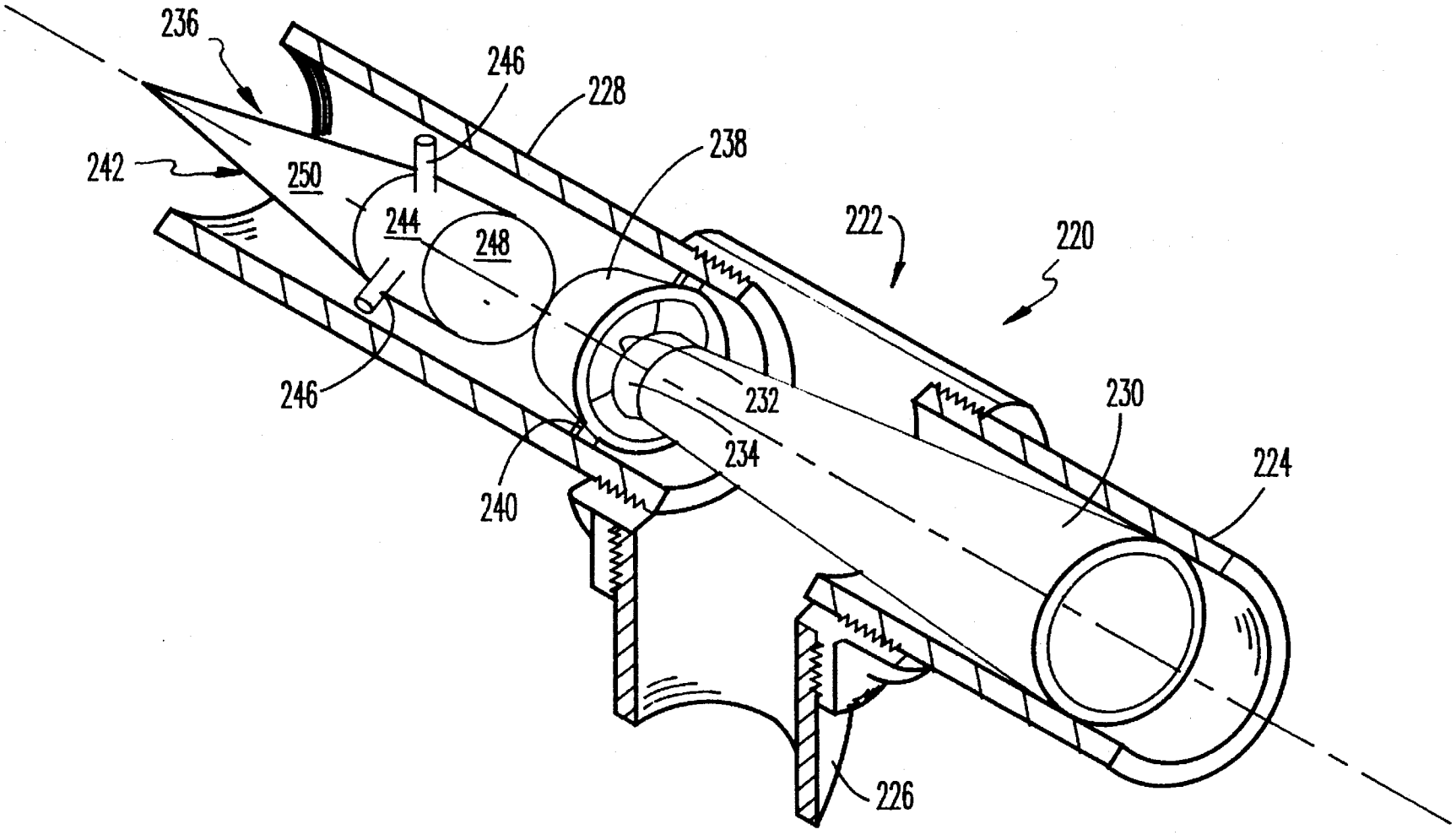
FIG. 7 is a broken isometric view of another embodiment of this invention.

Referring to FIG. 7, there is illustrated a jet pump 220 which is particularly suited to handle gas-liquid mixtures through the pump suction. The jet pump 220 comprises a housing 222 having a power fluid inlet end 224, a pumped fluid inlet 226 and a commingled fluid outlet 228. A power fluid inlet conduit 230 is sealed relative to the inlet end 224 of the housing 222 and extends downstream past the end of the pumped fluid inlet 226 providing an outlet opening 232. The power fluid inlet conduit 230 converges in the downstream direction and terminates in a conduit section 234 of constant diameter providing the outlet opening 232.

A downstream structure 236 comprises an annular shroud or sleeve 238 converging in the downstream direction and secured to the inside of the housing 222 by a plurality of struts 240. The upstream end of the shroud 238 overlaps the downstream end of the conduit section 234. The downstream structure 236 also comprises a member 242 having a central section 244 secured to the housing 222 by a plurality of struts 246, an upstream rounded section 248 and a downstream tapered section 250.

In use, relatively high volume, high pressure fluid, either gas, liquid or a mixture thereof, passes through the power fluid inlet 224 into the conduit 230. The velocity of the power fluid increases substantially and the pressure in the housing adjacent the downstream end of the power fluid inlet section 230 is thereby lowered substantially. This creates a low pressure area open to the pumped fluid inlet 226 allowing flow of the pumped fluid into the housing 222. Downstream of the conduit section 234 and downstream of the shroud 238, the power fluid and pumped fluid commingle and then pass around the structure 242. The velocity of the commingled stream falls across the structure 242 and the pressure rises, completing the pumping operation.

For reasons which are not entirely understood, the low pressure generated at the pumped fluid inlet 226 is quite remarkably low. Quite good vacuums have been achieved, even when handling substantial quantities of pumped fluids. The pump 220 is particularly desirable with gas-liquid mixtures as the pumped fluid.

Figure 8:
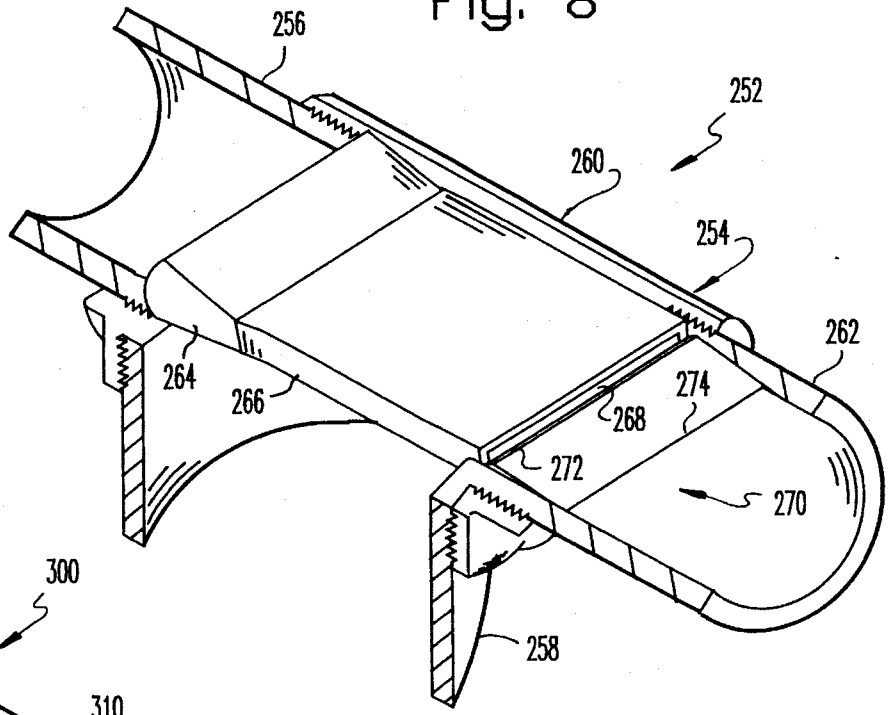
FIG. 8 is a broken isometric view of another embodiment of this invention.

Referring to FIG. 8, there is illustrated a jet pump 252 comprising a housing 254 having a power fluid inlet end 256, a pumped fluid inlet 258 opening into a bulge 260 of the housing 254 and a commingled fluid outlet 262. A power fluid inlet conduit 264 is sealed relative to the inlet end 256 of the housing 254 and extends downstream adjacent to or past the end of the pumped fluid inlet 258. The power fluid inlet conduit 264 converges in the downstream direction into a relatively flat generally rectangular outlet end terminating in a conduit section 266 of constant cross-sectional area providing an outlet opening 268.

A downstream structure 270 comprises a generally flat tapered member having an upstream rounded section 272 adjacent to and facing the outlet opening 268 and a downstream tapered section 274. The structure 270 is mounted for limited axial movement toward and away from the outlet opening 268 by any suitable means (not shown). By adjusting the structure 270 toward and away from the outlet opening 268, the operating characteristics of the jet pump 252 can be altered.

In use, relatively high volume, high pressure fluid, either gas, liquid or a mixture thereof, passes through the power fluid inlet 256 into the conduit 264. The velocity of the power fluid increases substantially and the pressure in the housing adjacent the downstream end of the power fluid inlet section 264 is thereby lowered substantially. This creates a low pressure area open to the pumped fluid inlet 258 allowing flow of the pumped fluid into the housing 254. Downstream of the conduit section 264, the power fluid and pumped fluid commingle and then pass around the structure 270. The velocity of the commingled stream falls across the structure 270 and the pressure rises, completing the pumping operation.

Figure 9:
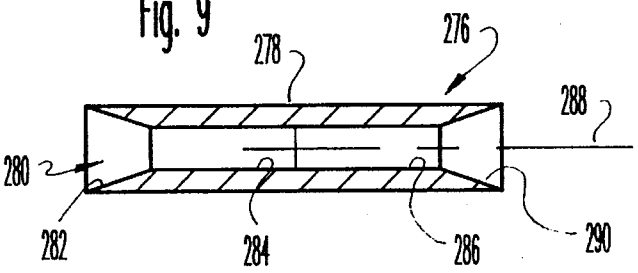
FIG. 9 is an enlarged cross-sectional view of a preferred form of a power fluid inlet conduit.

Referring to FIG. 9, there is illustrated a preferred form of power fluid inlet conduit 276 which may be used in any of the embodiments of this invention. The power fluid inlet conduit 276 comprises a tubular body 278 providing a passage 280 including a converging inlet end 282, a section 284 of substantially constant internal diameter, a section 286 which diverges slightly relative to a central axis 288 and an outlet section 290 which diverges substantially from the axis 288. The section 286 diverges from the axis 288 in the range of 2–8° preferably about 4° . The section 290 diverges from the axis 288 in the range of 25–35°, preferably about 30°. Although the lengths of the various passage sections are subject to wide variation, the section 282 should be on the order of about half the length of the conduit 276, the inlet and outlet ends 282,290 should be about the same length and the slightly diverging section 286 should be about twice the length of the outlet end 290. Tests have shown that the preferred power fluid inlet 276 is noticeably more efficient than a straight conduit of the same internal diameter as the section 284.

Figure 10:
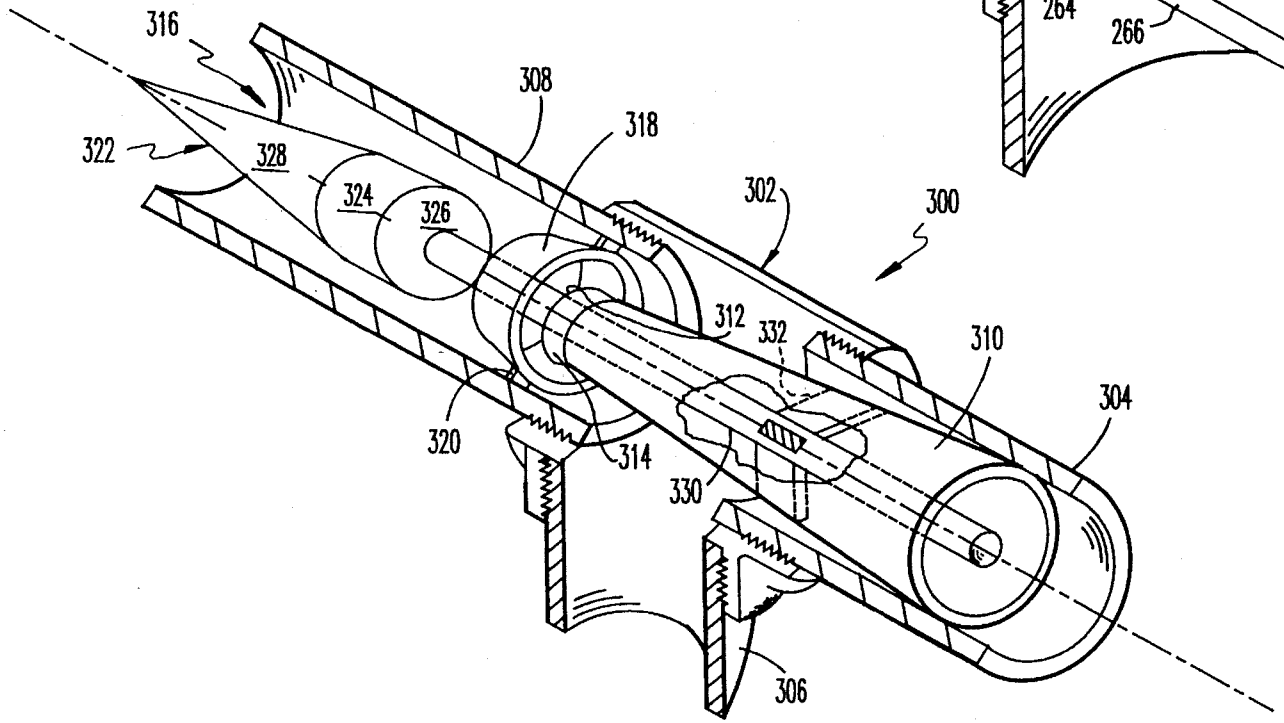
FIG. 10 is a broken isometric view of another embodiment of this invention.

Referring to FIG. 10, there is illustrated a jet pump 300 which is quite similar to the jet pump 220. The jet pump 300 differs from the pump 220 primarily in the means supporting the downstream structure. The pump 300 comprises a housing 302 having a power fluid inlet end 304, a pumped fluid inlet 306 and a commingled fluid outlet 308. A power fluid inlet conduit 310 is sealed relative to the inlet end 304 of the housing 302 and extends downstream past the end of the pumped fluid inlet 306 providing an outlet opening 312. The power fluid inlet conduit 310 converges in the downstream direction and terminates in a conduit section 314 of constant diameter providing the outlet opening 312.

A downstream structure 316 comprises an annular shroud or sleeve 318 converging in the downstream direction and secured to the inside of the housing 302 by a plurality of struts 320. The upstream end of the shroud 318 overlaps the downstream end of the conduit section 314. The downstream structure 316 also comprises a member 322 having a central cylindrical section 324, an upstream hemispherical or rounded section 326 and a downstream tapered or conical section 328. A rod 330 attaches to the member 322 and extends upstream through the shroud 318 and into the power fluid inlet conduit 310. A plurality of struts 332 secure the rod to the interior of the power fluid inlet conduit 310.

In use, relatively high volume, high pressure fluid, either gas, liquid or a mixture thereof, passes through the power fluid inlet 304 into the conduit 310. The velocity of the power fluid increases substantially and the pressure in the housing adjacent the downstream end of the power fluid inlet conduit 310 is thereby lowered substantially. This creates a low pressure area open to the pumped fluid inlet 306 allowing flow of the pumped fluid into the housing 302. Downstream of the conduit 310 and downstream of the shroud 318, the power fluid and pumped fluid commingle and then pass around the outside of the structure 322. The velocity of the commingled stream falls across the member 322 and the pressure rises, completing the pumping operation.

For reasons which are not entirely understood, the low pressure generated at the pumped fluid inlet 306 is quite remarkably low. Quite good vacuums have been achieved, even when handling substantial quantities of pumped fluids.

The pump 300 is particularly desirable with gas-liquid mixtures as the pumped fluid.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A jet pump comprising a housing having a pumped fluid inlet and elongate conduit section having an outlet spaced downstream from the pumped fluid inlet defining an axis of fluid movement;

a power fluid inlet including a conduit having an outlet opening into the housing parallel to the axis at a location between the pumped fluid inlet and the outlet; and a structure downstream of the power fluid inlet conduit, the structure including a body in the conduit section having a central axis on the axis of fluid movement, the body comprising a rounded upstream section downstream of the power fluid inlet conduit opening and a downstream section converging in the downstream direction, the body and conduit section providing a flow path therebetween, and an annular sleeve overlapping, at an upstream end thereof, a terminal end of the power fluid inlet, the annular sleeve being of larger size than the terminal end of the power fluid inlet providing communication between the pumped fluid inlet and the conduit section in an annular path along an interior of the annular sleeve, and the annular sleeve being of a smaller size than the conduit section providing open communication between the pumped fluid inlet and the conduit section in an annular path along an exterior of the annular sleeve.

2. The jet pump of claim 1 further comprising struts supporting the body to the conduit section.

3. The jet pump of claim 1 further comprising means supporting the body to the power fluid inlet conduit, the supporting means comprising a rod connected to the downstream structure and extending coaxial to the axis of fluid movement from the downstream structure into the power fluid inlet conduit and a plurality of struts supporting the rod from the interior of the power fluid inlet conduit.

4. The jet pump of claim 1 wherein the power fluid inlet conduit converges in the downstream direction.

5. The jet pump of claim 4 wherein the power fluid inlet conduit comprises a terminal section of constant diameter.

6. The jet pump of claim 1 wherein the body comprises a generally cylindrical center section between the rounded upstream section and the downstream converging section.

7. The jet pump of claim 6 wherein the downstream converging section tapers to a point.

8. The jet pump of claim 7 wherein the downstream converging section is generally conical.

9. The jet pump of claim 1 wherein the power fluid outlet being elongate in a direction transverse to the axis of fluid movement and extends substantially across the conduit section and the rounded upstream body section being elongate in the direction transverse to the axis of fluid movement.

10. The jet pump of claim 9 wherein the downstream converging section comprises an upstream end elongate in the direction transverse to the axis of fluid movement and a downstream end elongate in the direction transverse to the axis of fluid movement.

* * * * *